US009900934B2

(12) United States Patent
Brasseur et al.

(10) Patent No.: US 9,900,934 B2
(45) Date of Patent: Feb. 20, 2018

(54) METHOD AND A DEVICE FOR CHECKING AN IDEAL POSITION OF A COOKING POT ABOVE AN INDUCTION COIL OF AN INDUCTION COOKING HOB

(71) Applicant: Electrolux Appliances Aktiebolag, Stockholm (SE)

(72) Inventors: Jérôme Brasseur, Stockholm (SE); Ulrich Häutle, Rothenburg ob der Tauber (DE); Gerhard Klein, Rothenburg ob der Tauber (DE); Helmut Doebel, Rothenburg ob der Tauber (DE); Silke Horbaschek, Rothenburg ob der Tauber (DE)

(73) Assignee: Electrolux Appliances Aktiebolag, Stockholm (SE)

( * ) Notice: Subject to any disclaimer, the term of this patent is extended or adjusted under 35 U.S.C. 154(b) by 0 days.

(21) Appl. No.: 15/025,417

(22) PCT Filed: Jul. 3, 2014

(86) PCT No.: PCT/EP2014/064137
§ 371 (c)(1),
(2) Date: Mar. 28, 2016

(87) PCT Pub. No.: WO2015/074770
PCT Pub. Date: May 28, 2015

(65) Prior Publication Data

US 2016/0242238 A1 Aug. 18, 2016

(30) Foreign Application Priority Data

Nov. 25, 2013 (EP) ..... 13194251

(51) Int. Cl.
*H05B 6/12* (2006.01)
*H05B 6/08* (2006.01)
(Continued)

(52) U.S. Cl.
CPC ..... *H05B 6/062* (2013.01); *H05B 1/0258* (2013.01); *H05B 6/1218* (2013.01); *H05B 2213/05* (2013.01)

(58) Field of Classification Search
CPC . H05B 6/04; H05B 6/06; H05B 6/062; H05B 6/065; H05B 6/08; H05B 6/1218;
(Continued)

(56) References Cited

U.S. PATENT DOCUMENTS 5,296,684 A * 3/1994 Essig ..... H05B 3/746 219/447.1
5,319,174 A * 6/1994 Omori ..... H02M 7/53803 219/625
(Continued)

FOREIGN PATENT DOCUMENTS

DE 102006043182 A1 * 4/2007 ..... G01B 7/004
DE 102012204545 A1 9/2013
EP 2437573 A1 4/2012

OTHER PUBLICATIONS

International Search Report issued in PCT/EP2014/064137 dated Sep. 22, 2014, 3 pages.

*Primary Examiner* — Hung D Nguyen
(74) *Attorney, Agent, or Firm* — Pearne & Gordon LLP

(57) ABSTRACT

A method for checking an ideal position of a cooking pot above an induction coil of an induction cooking hob is provided. The method includes the steps of: detecting a first parameter related to the power of the electromagnetic field and/or to the position of the cooking pot above the induction coil, detecting a second parameter related to the power of the electromagnetic field and/or to the position of the cooking pot above the induction coil, comparing the detected first and second parameters with a stored relationship between the first and second parameters and the position of the cooking pot above the induction coil, determining a devia-
(Continued)

Figure 1:
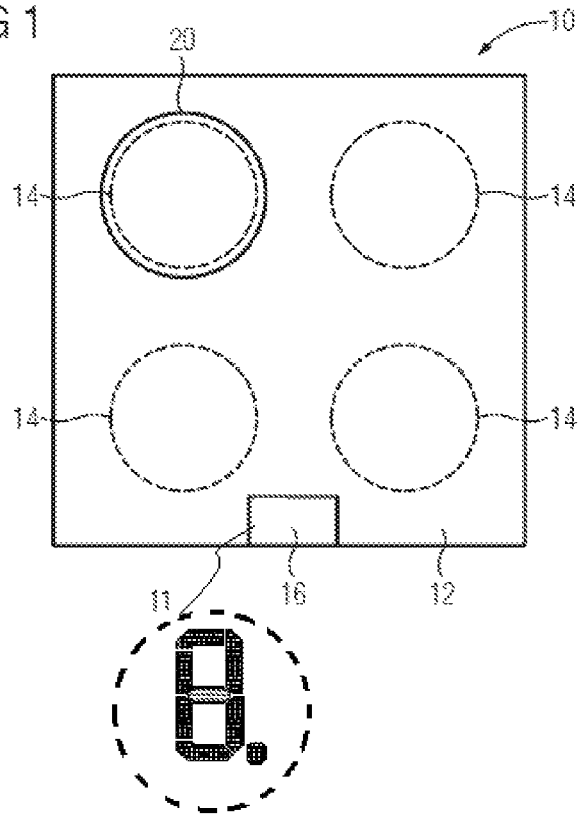

tion of the position of the cooking pot from the ideal position above the induction coil, and outputting at least one signal corresponding with the deviation of the position of the cooking pot from the ideal position, if the deviation exceeds a minimum value.

12 Claims, 2 Drawing Sheets

(51) Int. Cl.
*H05B 6/06* (2006.01)
*H05B 1/02* (2006.01)

(58) Field of Classification Search
CPC .. H05B 6/1245; H05B 6/1254; H05B 6/1272; H05B 1/0258; H05B 2213/04; H05B 2213/05; H05B 2213/07
USPC ..... 219/620, 621, 622, 626, 663, 665
See application file for complete search history.

(56) References Cited

U.S. PATENT DOCUMENTS

2009/0321425 A1 12/2009 Meier
2010/0181304 A1 7/2010 Gutierrez et al.

* cited by examiner

METHOD AND A DEVICE FOR CHECKING AN IDEAL POSITION OF A COOKING POT ABOVE AN INDUCTION COIL OF AN INDUCTION COOKING HOB

The present invention relates to a method for checking an ideal position of a cooking pot above an induction coil of an induction cooking hob. Further, the present invention relates to an induction cooking hob including a system for checking an ideal position of a cooking pot above an induction coil of said induction cooking hob.

A wrong or an inappropriate position of a cooking pot above an induction coil may cause a suboptimal cooking process. The wrong or inappropriate position of the cooking pot reduces the power transfer from the induction coil to said cooking pot. Further, the wrong or inappropriate position of the cooking pot may avoid an even browning of the foodstuff. Moreover, the wrong or inappropriate position of the cooking pot may cause slow heat up times. Additionally, the wrong or inappropriate position of the cooking pot may cause a too high power transfer into critical areas of the cooking pot, for example into the side walls of the cooking pot, resulting in damages.

However, the user often cannot recognize the ideal position of the cooking pot above the induction coil. It would be advantageous to check the ideal position of the cooking pot above the induction coil of the induction cooking hob.

It is an object of the present invention to provide a method and a system for checking an ideal position of a cooking pot above an induction coil of an induction cooking hob by low complexity.

This is achieved by the method for checking an ideal position of a cooking pot above an induction coil of an induction cooking hob according to claim 1.

The method of the present invention includes the following steps:

a) starting the method for checking the ideal position, b) detecting a first parameter related to the power of the electromagnetic field and/or to the position of the cooking pot above the induction coil, c) detecting a second parameter related to the power of the electromagnetic field and/or to the position of the cooking pot above the induction coil, d) comparing the detected first and second parameters with a stored relationship between said first and second parameters and the position of the cooking pot above the induction coil, e) determining a deviation of the position of the cooking pot from the ideal position above the induction coil, f) performing periodic repetitions of the steps b) to e) after a predetermined time, and g1) outputting at least one signal corresponding with the deviation of the position of the cooking pot from the ideal position, if said deviation exceeds a minimum value, or g2) outputting at least one signal corresponding with the deviation of the position of the cooking pot from the ideal position, if said deviation falls below a maximum value.

The main idea of the present invention bases on the fact that the power of the electromagnetic field is maximal, if the cooking pot is in an ideal position above the induction coil. In contrast, the power of the electromagnetic field decreases, if the position of the cooking pot deviates from said ideal position. Thus, the detections of parameters related to the power of the electromagnetic field provide information about the deviation from the ideal position of the cooking pot. The method may be performed by components, which are already available in the induction cooking hob. If both the cooking pot and the induction coil have circular base areas, then the ideal position is obtained, when the distance between the centres of the cooking pot and the induction coil becomes zero.

Preferably, the first parameter is a current through the induction coil. The current through the induction coil can be detected by components, which are already available in the induction cooking hob.

In particular, the second parameter is a phase difference between the current through the induction coil and a voltage at said induction coil. Also the voltage and therefore the phase difference can be detected by already available components of the induction cooking hob. For example, the phase difference is detected by measuring the time elapsed between one edge of a square wave voltage and a zero-crossing of the current through the induction coil. In particular, the square wave is used for driving a half-bridge induction generator.

Another parameter may be the frequency change of the current through the induction coil and/or of the voltage at said induction coil. Said frequency change may occur during a displacement of the cooking pot above the induction coil.

A further parameter may be the difference between a desired value and an actual value of the power of the electromagnetic field. For example, said desired value may be stored in a memory device or in a user interface.

Moreover, the current profile through the induction coil may be used as parameter. In particular, the deviation of the current profile from the sinusoidal signal is internally detectable. The deviation of the current profile from the sinusoidal signal may be used for evaluating the deviation of the position of the cooking pot from the ideal position above the induction coil.

Alternatively or additionally, a further parameter may be a setting parameter of the induction coil and/or the frequency at the induction coil.

For example, the method may be started by operating an actuator of a user interface. The method may be manually started by operating the actuator of the user interface.

Alternatively, the method may be started by a cooking pot movement caused by the user. In such a case the method steps a) through f) will be executed periodically and the method step g1) or g2) will be executed only on a change of the deviation as determined in method step e).

In particular, at least one parameter has a minimum or maximum, if the cooking pot is in the ideal position above the induction coil. In this case, specific output signals may correspond with an increasing and decreasing, respectively, of the value of said parameter. This allows a clear indication, if the cooking pot is moved to or away from the ideal position during said cooking pot is moved by the user.

Further, a power of the electromagnetic field generated by the induction coil may be detected and used for the determination of the deviation of the position of the cooking pot.

Moreover, the predetermined time between subsequent periodic repetitions of the steps b) to e) is between 0.1 s and 1.0 s, preferably 0.5 s.

Preferably, the signal is an optical, acoustic and/or mechanical signal.

The object of the present invention is further achieved by the induction cooking hob including a system for checking an ideal position of a cooking pot above an induction coil of said induction cooking hob according to claim 7.

The system for checking the ideal position of the cooking pot above the induction coil includes:

a first detection device for detecting a first parameter related to the power of the electromagnetic field and/or to the position of the cooking pot above the induction coil, a second detection device for detecting a second parameter related to the power of the electromagnetic field and/or to the position of the cooking pot above the induction coil, a control unit for comparing the detected first and second parameters with a stored relationship between said first and second parameters and the position of the cooking pot above the induction coil, for determining a deviation of the position of the cooking pot from the ideal position above the induction coil, and for performing periodic repetitions of the detections, comparison and determination after a predetermined time, and an output device for outputting at least one signal corresponding with the deviation of the position of the cooking pot from the ideal position.

The invention bases on the effect, that the power of the electromagnetic field is maximal only, if the cooking pot is in an ideal position above the induction coil. In contrast, the power of the electromagnetic field decreases, if the position of the cooking pot deviates from said ideal position. Thus, the detections of the parameters related to the power of the electromagnetic field provide information about the deviation from the ideal position of the cooking pot. The system may use components, which are already available in the induction cooking hob.

Preferably, the first detection device is provided for detecting a current through the induction coil.

In particular, the second detection device is provided for detecting a phase difference between the current through the induction coil and a voltage at said induction coil.

Additionally or alternatively, the first and/or second detection devices may be provided for detecting a setting parameter of the induction coil and/or the frequency at the induction coil.

Further, the induction cooking hob may comprise an actuator for starting a method for checking the ideal position of the cooking pot above the induction coil. Preferably, the actuator is a part of a user interface of the induction cooking hob. Thus, a user can manually start the method for checking the ideal position.

Additionally, the induction cooking hob comprises a detection device for detecting a power of an electromagnetic field generated by the induction coil.

Moreover, the output device may include at least one display, a sound generator and/or a mechanical indicator.

Furthermore, the induction cooking hob may include a user interface, wherein at least one component of the output device is an integrated part of said user interface.

For example, the output device includes at least one seven-segment display, wherein the number of the activated segments corresponds with the deviation of the position of the cooking pot from the ideal position above the induction coil.

At last the present invention relates to a computer program product stored on a computer usable medium, comprising computer readable program means for causing a computer to perform the method mentioned above.

Novel and inventive features of the present invention are set forth in the appended claims.

Figure 2:
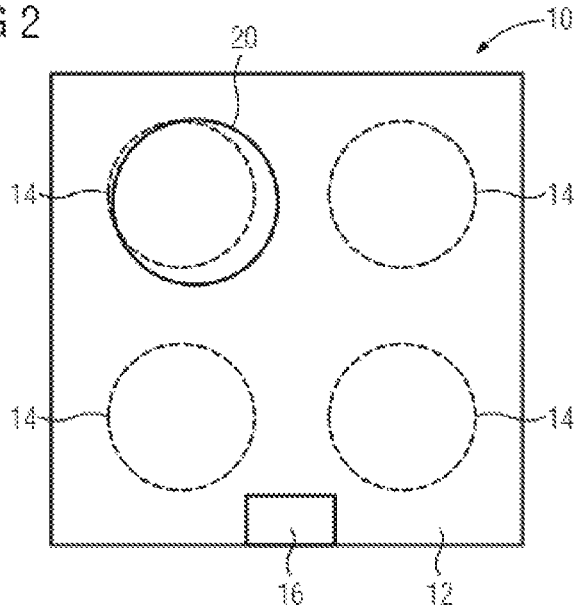
Figure 3:
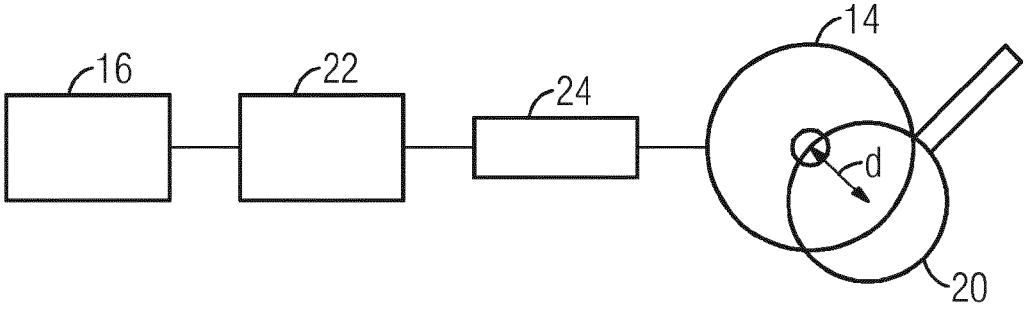
Figure 4:
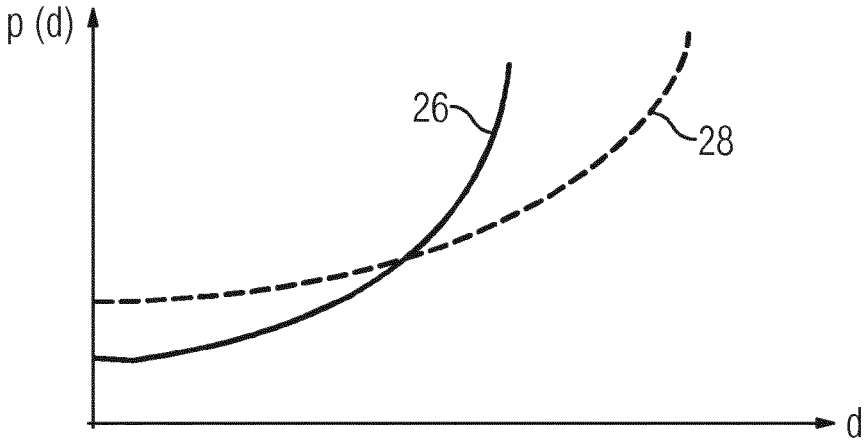
Figure 5:
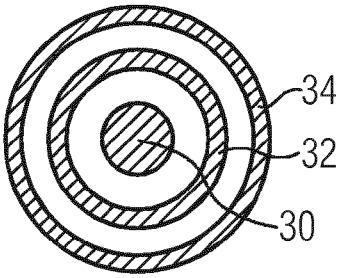

The present invention will be described in further detail with reference to the drawings, in which FIG. 1 illustrates a schematic top view of an induction cooking hob according to a preferred embodiment of the present invention, FIG. 2 illustrates a further schematic top view of the induction cooking hob according to the preferred embodiment of the present invention, FIG. 3 illustrates a schematic electrical block diagram of the induction cooking hob according to the preferred embodiment of the present invention, FIG. 4 illustrates a schematic diagram of an electric parameter as function of the distance between the centres of an induction coil and a cooking pot according to the preferred embodiment of the present invention, and FIG. 5 illustrates an example of a visual symbol for indicating the distance between the centres of the induction coil and the cooking pot according to the preferred embodiment of the present invention.

FIG. 1 illustrates a schematic top view of an induction cooking hob 10 according to a preferred embodiment of the present invention.

The induction cooking hob 10 includes a cooking panel 12, induction coils 14 and a user interface 16. The induction coils 14 are arranged below the cooking panel 12. In this example, the induction cooking hob 10 includes four induction coils 14. The cooking panel 12 comprises four cooking zones corresponding with one induction coil 14 in each case. In this example, the cooking zones and the corresponding induction coils 14 are circular. In general, the cooking zones and the induction coils 14 may have other geometrical shapes. In this preferred embodiment, the induction cooking hob 10 includes two front induction coils 14 and two rear induction coils 14. The both front induction coils 14 are arranged side by side. In a similar way, the both rear induction coils 14 are also arranged side by side.

The user interface 16 comprises control elements. Said control elements are provided for activating and deactivating the induction coils 14. Further, the control elements are provided for adjusting the power of the induction coils 14. Moreover, the user interface 16 comprises an actuator for starting a method for checking the ideal position of the cooking pot above the induction coil. Additionally, the user interface 16 may comprise one or more display elements. Said display elements are provided for indicating activated and/or deactivated states of the induction coils 14. Moreover, the display elements are provided for indicating the power of the induction coils 14.

A cooking pot 20 is arranged upon one of the cooking zones. The cooking pot 20 is arranged concentrically above the left rear induction coil 14. The concentric arrangement of the cooking pot 20 above the induction coil 14 allows a maximum power of the electromagnetic field generated by said induction coil 14. Said concentric arrangement above the induction coil 14 is the ideal position of the cooking pot 20. Since the base area of the cooking pot 20 is bigger than the induction coil 14, the cooking pot 20 covers completely the induction coil 14.

FIG. 2 illustrates a further schematic top view of the induction cooking hob 10 according to the preferred embodiment of the present invention.

The induction cooking hob 10 and the cooking pot 20 are the same as in FIG. 1. However, the position of the cooking pot 20 in FIG. 2 is displaced relating to the left rear induction coil 14. The cooking pot 20 does not completely cover the induction coil 14. The power of the electromagnetic field generated by the induction coil 14 is smaller than in FIG. 1, since the cooking pot 20 is not concentrically arranged above the left rear induction coil 14.

The induction cooking hob 10 includes a system for checking the ideal position of the cooking pot 20 above the induction coil 14. The system includes at least two detection devices for detecting parameter values relating to the power of the electromagnetic field and/or to the position of the cooking pot above the induction coil. Preferably, said parameter values are the current through the induction coil and the phase difference between said current and a voltage at said induction coil.

Moreover, the system includes a memory device. A relationship between the parameter values and a deviation of the cooking pot 20 from the ideal position above the induction coil 14 is stored in said memory device. The detected parameter values are compared with the relationship stored in the memory device by a control unit of the induction cooking hob 10. The deviation of the cooking pot 20 from the ideal position can be determined from the detected parameter values.

Furthermore, the actual detected parameter values are stored in the memory device. Said detected parameter values remain stored at least during the actual cooking process. Optionally, the detected parameter values remain stored after the cooking process has been finished and may be used as reference values for later cooking processes.

Preferably, a method for checking for checking the ideal position of the cooking pot above the induction coil is manually started by operating the actuator of the user interface 16 by a user. A first parameter and second parameter related to the power of the electromagnetic field and/or to the position of the cooking pot above the induction coil are detected. The detected first and second parameters are compared with a stored relationship between said first and second parameters and the position of the cooking pot above the induction coil. Then, a deviation of the position of the cooking pot from the ideal position above the induction coil is determined. The above detections, comparison and determination are periodically repeated after a predetermined time. At last, one or more signals corresponding with the deviation of the position of the cooking pot from the ideal position are output, if said deviation exceeds a minimum value.

Preferably, the parameters are the current through the induction coil and the phase difference between the current through the induction coil and the voltage at said induction coil. The current and the voltage and therefore the phase difference can be detected by already available components of the induction cooking hob 10.

A further parameter may be the frequency change of the current through the induction coil 14 and/or of the voltage at said induction coil 14. Said frequency change may occur during a displacement of the cooking pot 20 above the induction coil 14.

Another parameter may be the difference between a desired value and an actual value of the power of the electromagnetic field. For example, said desired value may be stored in a memory device or in the user interface 16.

Further, the current profile through the induction coil 14 may be used as parameter. For example, the deviation of the current profile from the sinusoidal signal is internally detectable. The deviation of the current profile from the sinusoidal signal may be used for evaluating the deviation of the position of the cooking pot 20 from the ideal position above the induction coil 14.

The predetermined time between subsequent periodic repetitions of the detections, comparison and determination is between 0.1 s and 1.0 s, preferably 0.5 s.

Furthermore, the system includes an output device for a signal indicating that the cooking pot 20 deviates from the ideal position and/or that the cooking pot 20 is in the ideal position. The output device provides an optical, acoustic and/or mechanical signal. The output device may be an integrated part of the user interface 16. For example, the output device includes a seven-segment display 11, wherein the horizontal lines of the seven-segment display 11 indicate the deviation of the cooking pot 20. In this case, one activated horizontal line corresponds with a bad position of the cooking pot 20. Two activated horizontal lines correspond with an acceptable position of the cooking pot 20. Three activated horizontal lines correspond with a perfect position of the cooking pot 20.

FIG. 3 illustrates a schematic electrical block diagram of the induction cooking hob 10 according to the preferred embodiment of the present invention. In this example, the induction cooking hob 10 includes the user interface 16, a control unit 22, an induction generator 24 and the induction coil 14. The cooking pot 20 is arranged above the induction coil 14. There is a distance d between the centres of the cooking pot 20 and the induction coil 14.

For example, the induction generator 24 is implemented as a half-bridge inverter. The input of the induction generator 24 receives digital signals from the control unit 22 in order to drive the power section of said induction generator 24. For example, the power section provides square wave signals with variable frequency and/or duty cycle. Further, the induction generator 24 gives back one or more parameters to the control unit 22, which parameter or parameters, respectively, identifies the working point of said induction generator 24. For example, the parameter is an analogue signal representing the peak of the current flowing through the induction coil. According to another example, the parameter is an analogue signal representing the measured time between one edge of the square wave and the zero-crossing of the coil current.

In general, the control unit 22 can drive one or more induction generators 24. The input of the control unit 22 receives the target power transfer to the cooking pot 20 from the user interface 16. The control unit 22 implements a power control loop by estimating the actual power transfer to the cooking pot 20 and adjusting by consequence the digital signal controlling the working point of the induction generator 24. For example, the control unit 22 acts on the frequency and/or duty cycle of the power section of the induction generator 24. The actual power transfer to the cooking pot 20 is estimated by means of the parameters received from the induction generator 24.

The user interface 16 includes means for interacting with the user. For example, the user interface 16 includes touch-keys, a display and/or a buzzer.

FIG. 4 illustrates a schematic diagram of an electric parameter p(d) of an induction coil as function of the distance d between the centres of the induction coil 14 and cooking pot 20 according to the preferred embodiment of the present invention.

Some electric parameters p(d) sent by the induction generator 24 to the control unit 22 depend on the distance d between the centres of the induction coil 14 and cooking pot 20. FIG. 4 shows two different curves 26 and 28. For example, the curves 26 and 28 may relate to two different types of cooking pots 20. According to another example, the curves 26 and 28 may relate to the same cooking pot 20 at two different temperatures. In both curves 26 and 28, the parameter p(d) reaches its minimum value, when the cooking pot 20 in centred above the induction coil 14, i.e. d=0.

Further, the function p(d) may be also implemented even if said function p(d) would have a maximum at d=0.

An algorithm for checking the ideal position of the cooking pot 20 above the induction coil 14 is described below. The algorithm bases on the detection of a variation of the parameter p(d), while the user is moving the cooking pot 20 on the cooking surface 12 of the induction cooking hob 10. Acoustic and/or visual signals guide the user to the ideal position of the cooking pot 20.

After the user has activated the cooking zone by operating the user interface 16, a "pan centring mode" is started. The "pan centring mode" lasts for a predetermined time. For example, said predetermined time is about ten seconds. This relative short predetermined time ensures that the temperature of the cooking pot 20 is changed only marginally, so that the variation of the temperature do not influence the parameter p(d).

The "pan centring mode" may be implemented by two different ways.

According to the first way the control unit 22 includes a dedicated device for driving the induction generator 24 with a fixed digital signal. For example, said device drives the induction generator 24 at a fixed frequency, e.g. 50 kHz. The user interface 16 sends a message to the control unit 22 in order to activate said device.

According to the second way the user interface 16 sends a fixed predetermined power request to the control unit 22. The corresponding power has to be low in order to obtain a slow heating up of the cooking pot 20. For example, the power is about 400 W.

The user slides slowly the cooking pot 20 on the cooking surface 12 of the induction cooking hob 10. The user can keep the cooking pot 20 moving as long as the "pan centring mode" is active. The control unit samples the parameter p(d) periodically. For example, the value of the parameter p(d) is sampled every 200 ms. The value of the parameter p(d) at time t is given by the parameter p(d,t).

The information about the sampled parameters p(d,t) is sent to the user interface 16. The user interface 16 compares two subsequent parameters p(d1,t1) and p(d2,t2), wherein the parameter p(d1,t1) is the last sample, while the parameter p(d2,t2) is the previous sample.

Assuming the parameter p(d) has its minimum when d=0, then p(d1,t1)>p(d2,t2) means that the cooking pot 20 is moving away from the centre of the induction coil 14, while p(d1,t1)<p(d2,t2) means that the cooking pot 20 is moving toward the centre of said induction coil 14. Further, if p(d1,t1)=p(d2,t2), then it is assumed that the cooking pot 20 is standing still.

The user interface 16 generates acoustic and/or visual indications as feedback to the user on the position of the cooking pot 20. For example, the user interface 16 may generate beeps getting more frequent, if the cooking pot 20 is moving close to the centre of the induction coil 14. Further, the user interface 16 may indicate a light of increasing intensity, if the cooking pot 20 is moving closer to the centre of the induction coil 14.

FIG. 5 illustrates an example of a visual symbol for indicating the distance d between the centres of the induction coil 14 and the cooking pot 20 according to the preferred embodiment of the present invention.

The visual symbol includes three illuminated areas, namely a central circle 30, an inner ring 32 and an outer ring 34. One of said illuminated areas is activated in the "pan centring mode".

For example, the outer ring 34 is activated, if the cooking pot 20 is moving away from the centre of the induction coil 14. In a similar way, the central circle 30 is activated, if the cooking pot 20 is moving toward the centre of the induction coil 14. At last, the inner ring 32 is activated, if the cooking pot 20 is standing still.

When the predetermined time of the "pan centring mode" expires, then the cooking process is set forth in a conventional way. The user interface 16 sends the power request according to the user's choice to the control unit 22.

The method and system according to the present invention may be applied for an inducting cooking hob having a plurality of small induction coils. For example, the diameter of said induction coils is about 8 cm.

The present invention allows the user an opportunity to check the position of the cooking pot above the induction coil. The user gets the opportunity to place the cooking pot in the ideal position of the cooking pot above the induction coil in order to optimize the cooking results. The ideal position of the cooking pot allows an even browning of the foodstuff. Further, the ideal position of the cooking pot allows a good power transfer into the bottom of the cooking pot resulting in fast heat up times. The user is guided by the indication how to place the cooking pot on the ideal position.

Although an illustrative embodiment of the present invention has been described herein with reference to the accompanying drawings, it is to be understood that the present invention is not limited to that precise embodiment, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 induction cooking hob
11 seven-segment display
12 cooking surface
14 induction coil
16 user interface
20 cooking pot
22 control unit
24 induction generator
26 first curve
28 second curve
30 central circle
32 inner ring
34 outer ring
p parameter
d distance
t time

The invention claimed is:

1. A method for checking an ideal position of a cooking pot above an induction coil of an induction cooking hob, wherein said method includes the following steps:

a) starting the method for checking the ideal position,
b) detecting a first parameter related to the power of an electromagnetic field associated with said coil,
c) detecting a second parameter related to the power of the electromagnetic field,
d) comparing the detected first and second parameters with a stored relationship between said first and second parameters and the position of the cooking pot above the induction coil,
e) determining a deviation of the position of the cooking pot from the ideal position above the induction coil,
f) performing periodic repetitions of the steps b) to e) after a predetermined time, and g1) outputting at least one signal corresponding with the deviation of the position of the cooking pot from the ideal position, if said deviation exceeds a minimum value, or g2) outputting at least one signal corresponding with the deviation of the position of the cooking pot from the ideal position, if said deviation falls below a maximum value, wherein the first parameter is a current through the induction coil and the second parameter is a phase difference between the current through the induction coil and a voltage at said induction coil.

2. The method according to claim 1, wherein the method is started by operating an actuator of a user interface.

3. The method according to claim 1, wherein at least one of said first and second parameters has a minimum or maximum if the cooking pot is in the ideal position above the induction coil.

4. The method according to claim 1, wherein the predetermined time between subsequent periodic repetitions of the steps b) to e) is between 0.1 s and 1.0 s.

5. The method according to claim 1, wherein the predetermined time between subsequent periodic repetitions of the steps b) to e) is 0.5 s.

6. The method according to claim 1, wherein the phase difference is detected by measuring the time elapsed between one edge of a square wave voltage and a zero-crossing of the current through the induction coil.

7. An induction cooking hob including a system for checking an ideal position of a cooking pot above an induction coil of the induction cooking hob, wherein said system includes:

a first detection device for detecting a first parameter related to the power of an electromagnetic field associated with said coil, a second detection device for detecting a second parameter related to the power of the electromagnetic field, a control unit for comparing the detected first and second parameters with a stored relationship between said first and second parameters and the position of the cooking pot above the induction coil, for determining a deviation of the position of the cooking pot from the ideal position above the induction coil, and for performing periodic repetitions of the detections, comparison and determination after a predetermined time, and an output device for outputting at least one signal corresponding with the deviation of the position of the cooking pot from the ideal position, wherein the first detection device detects a current through the induction coil and the second detection device detects a phase difference between the current through the induction coil and a voltage at said induction coil.

8. The induction cooking hob according to claim 7, wherein the induction cooking hob comprises an actuator for starting a method for checking the ideal position of the cooking pot above the induction coil.

9. The induction cooking hob according to claim 7, wherein the induction cooking hob comprises a detection device for detecting the power of said electromagnetic field.

10. The induction cooking hob according to claim 7, wherein the output device includes at least one display, a sound generator and/or a mechanical indicator.

11. The induction cooking hob according to claim 7, wherein the induction cooking hob includes a user interface, wherein at least one component of the output device is an integrated part of said user interface.

12. The induction cooking hob according to claim 4, wherein the output device includes at least one seven-segment display, wherein the number of the activated segments corresponds with the deviation of the position of the cooking pot from the ideal position above the induction coil.

* * * * *